United States Patent [19]

Nakagawa

[11] 4,007,563

[45] Feb. 15, 1977

[54] DECK ANCHOR

[76] Inventor: Momoki Nakagawa, 1-8-4 Sakai, Musashino, Tokyo, Japan

[22] Filed: June 2, 1975

[21] Appl. No.: 583,324

[52] U.S. Cl. ..... 52/98; 52/334; 52/378

[51] Int. Cl.[2] ..... E04B 1/16

[58] Field of Search ..... 52/334, 698, 335, 699, 52/336, 704, 98, 39, 443, 378; 85/DIG. 2, 5, 72, 77, 82, 1 T; 24/73 P; 151/41.75, 49, 50

[56] References Cited

UNITED STATES PATENTS

| | | | |
|---|---|---|---|
| 2,108,842 | 2/1938 | Bazzoni | 85/72 |
| 3,641,866 | 2/1972 | Mortensen | 85/72 |
| 3,769,774 | 11/1973 | Barnes | 52/39 |
| 3,782,437 | 1/1974 | Seckerson | 151/41.75 |
| 3,896,599 | 7/1975 | Werstein | 52/39 |

FOREIGN PATENTS OR APPLICATIONS

| | | | |
|---|---|---|---|
| 806,962 | 1/1959 | United Kingdom | 85/DIG. 2 |

*Primary Examiner*—John E. Murtagh
*Attorney, Agent, or Firm*—William Anthony Drucker

[57] ABSTRACT

A deck anchor, for securing in a hole in a metal plate in concrete building structures, has a stem with a connector at one end, and an assembly slidable on said stem and urged by spring loading towards the connector. The assembly includes a washer, and a collar portion, initially integrally joined by rupturable bridging means. When the anchor is driven, by force applied on the stem, to thrust the assembly through a hole in a deck plate, the collar portion is separated from the washer, such that the anchor becomes retained in the hole of the deck plate with the washer spring-urged against one major face of the deck plate, and the collar urged against the other major face of the deck plate.

5 Claims, 7 Drawing Figures

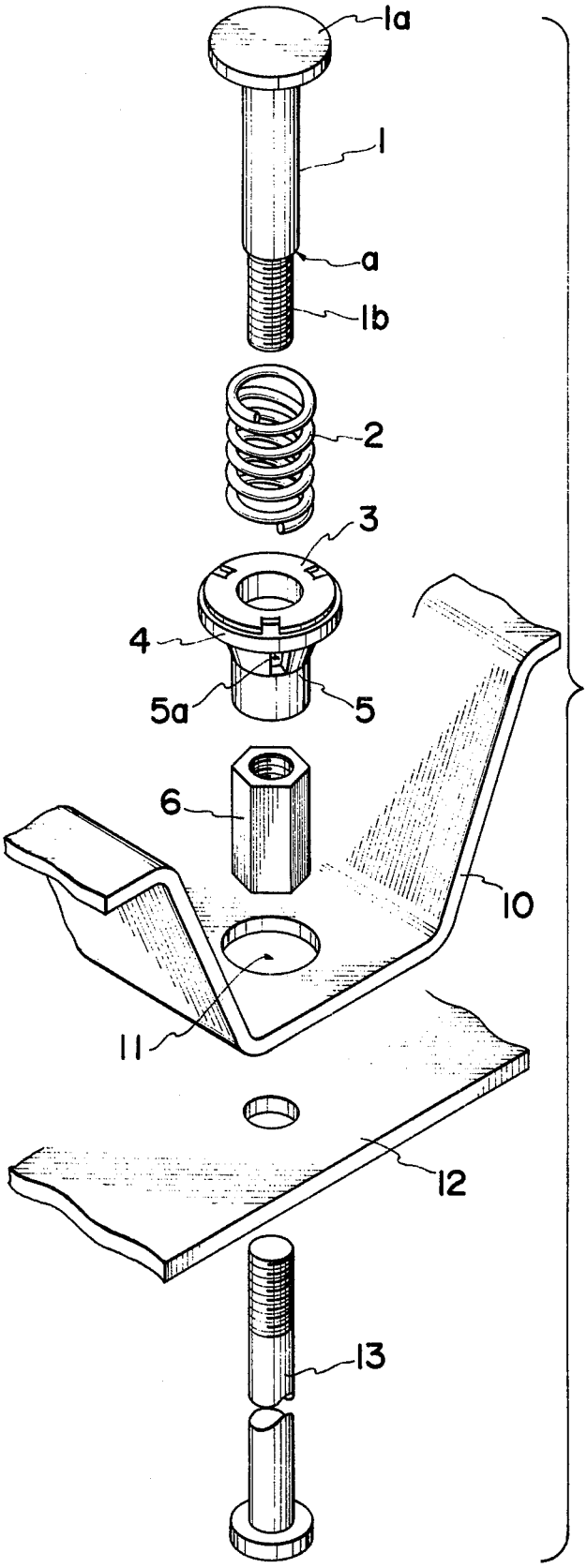
FIG. 1
FIG. 2
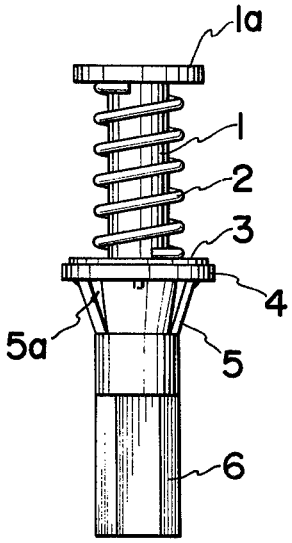
FIG. 3
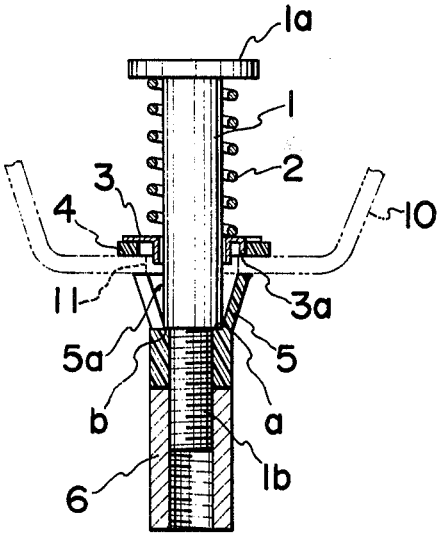

DECK ANCHOR

BACKGROUND OF THE INVENTION

It is known, in the art of concrete building structures, to provide deck anchors which are positioned in and protruding from a deck plate, whereafter concrete is poured onto the deck plate and about the deck anchor to secure it in position. The deck anchor includes a connecter at its protruding end, and means such as a bolt may be used to secure other material, such as a ceiling plate, to the anchor. In the constructions of deck anchor known hitherto, they were difficult to place and secure in position in a deck plate, and they were difficult to retain in a correct perpendicular position prior to pouring of the concrete, especially if trodden on by a workman. Further, it has not hitherto been possible to insert and secure a deck anchor in a single punch operation.

OBJECTS OF THE INVENTION

The main object of the invention is to provide a deck anchor which can be very rapidly fitted to a deck plate, for instance in a single punch operation, and will be securely and firmly held in the deck plate normal to the plane of the deck plate.

Another object of the invention is to provide a deck anchor in which elements which abut the two major faces of the deck plate are springloaded so as to retain the deck anchor in position perpendicular to the deck plate.

BRIEF DESCRIPTION OF THE INVENTION

In accordance with the present invention a deck anchor, for use in concrete building structures, comprises a stem, an assembly including a washer and a coaxial collar slidable on said stem, said washer and collar being formed of a resiliently deformable material and being integrally connected by bridging means, said collar being axially slotted, a connector engaged on an end portion of said stem, stop means on said stem remote from said connector, and a compression spring abutting at one end against said stop means and at the other end against said assembly to urge said assembly towards said connector.

In a preferred construction, the assembly further comprises a metal plate seated on the washer and between the washer and the spring, said metal plate having lug means thereon extending axially through and beyond the opening of the washer. The stem comprises a shoulder at an intermediate point along its length, the collar including a shoulder adapted to abut against the shoulder of the stem, thereby to transmit, from the stem to the collar, driving forces acting axially in the direction along the stem towards the connector. The collar includes a frustoconical portion in which a plurality of slots are formed, and a cylindrical portion connected integrally to the narrower end of said frustoconical portion, said frustoconical portion being connected at its broader end by said bridging means to said washer. The stem and the stop means advantageously constitute a bolt, with the stop means forming a head for the bolt. The connector may conveniently be a nut engaged by screwthreading on a threaded portion of the stem and extending axially beyond the free end of the threaded portion, e.g. to receive another bolt serving for securing in position a member such as a ceiling sheet.

SHORT DESCRIPTION OF THE DRAWINGS

FIG. 1 is a perspective view showing a deck anchor of the present invention in disassembled condition, together with a deck plate, ceiling sheet and hanging bolt;

FIG. 2 is a side elevation of the deck anchor of the present invention in assembled condition;

FIG. 3 is a side elevation, with parts shown in cross section, of the deck anchor;

Figure 4:
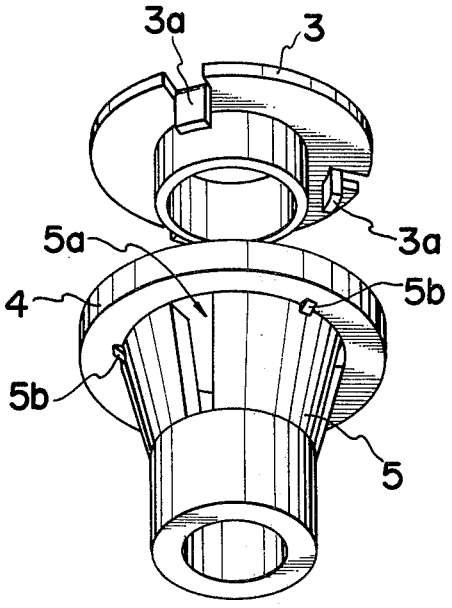
FIG. 4 is a perspective view of a collar to be assembled with a metal plate and to a plastics washer.
Figure 5:
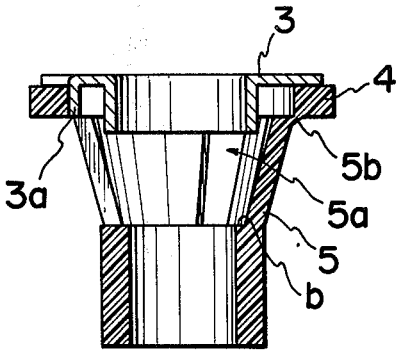
FIG. 5 is a cross section showing the items of FIG. 4 in assembled condition.
Figure 6:
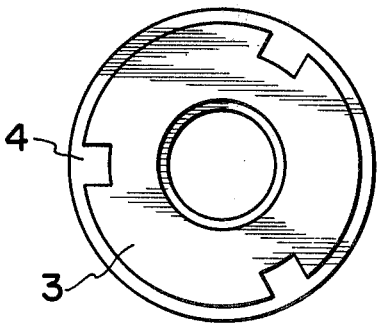
FIG. 6 is a plan view corresponding to FIG. 5.
Figure 7:
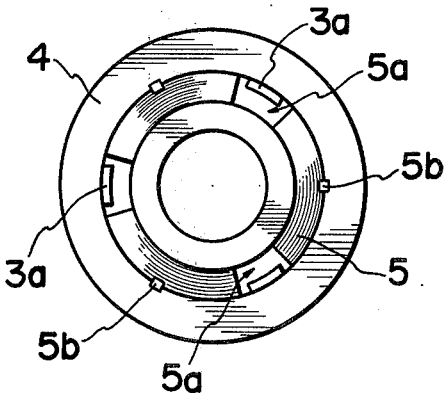
FIG. 7 is an underplan view corresponding to FIG. 5.

The anchor of the present invention is composed of some metal members, a plastics collar, and a washer molded integrally with the plastics collar.

DESCRIPTION OF THE PREFERRED EMBODIMENT

The anchor illustrated is composed of a bolt 1, a coiled compression spring 2, a plastics washer 4 assembled with a metal plate 3, a collar 5 integrally molded with the washer 4, and an internally threaded nut 6 mounted on the threaded end tip of the bolt 1.

A step portion *a* is formed on the lower part of the bolt 1, where the smooth portion meets with male thread 1*b*. The spring 2 is fitted on the bolt. The collar 5, whose material is the same as that of the plastics washer 4, is molded integrally with said washer so as to be initially connected at bridging pieces 5*b*. The metal plate 3 is attached on the upper surface of the washer 4, and a plurality of lugs 3*a* are provided on the metal plate to project axially therefrom such that the tips of the lugs protrude at the lower surface of the washer 4. The bolt 1 is inserted through the metal plate 3, washer 4 and collar 5, and the nut 6 is screwed onto the male thread 1*b* of the bolt 1.

Reference numeral 10 denotes a deck plate, and 11 denotes a hole in the deck plate through which the deck anchor is inserted; 12 denotes a sheet forming part of a ceiling. 13 denotes a bolt to be screwed into the nut 6 for hanging an article, such as the ceiling sheet 12.

The method of use of the deck anchor of the present invention will now be described.

The deck anchor of the present invention is shown in FIG. 2, and this deck anchor is inserted into the hole 11 of the deck plate 10 by striking the head 1*a* of the bolt. This causes the collar 5 to become radially compressed, and the bridging pieces 5*b* between the washer 4 and the collar 5 are broken, parts of each bridging piece being left attached to the washer 4 and the collar 5. The bridging pieces are designed to be easily broken. At the same time, an inner step portion *b* of the collar is forced down by the bolt step portion *a*, which facilitates breaking of the bridging pieces.

When the collar 5 passes through the hole 11, the portion of the collar 5 having slots 5*a* therein springs open again, by virtue of the resilience of the plastics material. As the spring 2 pushes the washer 4 against the deck plate 10, the washer 4 cannot slide laterally, and it acts as a packing which prevents water leakage.

When the bolt head 1*a* is struck, the spring 2 is temporarily compressed, but when the striking force ceases, the bolt head is thrust away from the deck plate 10 by the force of the spring 2, and the collar 5 is urged into tight contact with the undersurface of the deck plate 10. The metal plate 3 overlies the washer 4 seated on the upper surface of the deck plate 10, and the tips of the lugs 3*a* of the metal plate 3 pass through the washer 4 and project at the underside thereof, whereby said tips come into contact with the deck plate 10, and the bolt and the deck plate become in electrically conductive contact so that the operation of electric welding can be carried out.

A bolt 13 can be engaged into the nut 6 projecting at the underside of the deck plate, to hang a ceiling sheet 12 or the like.

The collar is initially attached to the washer by being molded integrally, and therefore the collar segments have wholly a uniform angle, and retain their proper shape during transportation.

The plastics member becomes separated into two portions (washer 4 and collar 5) only after passing of the collar 5 through the hole of the deck plate, and the washer and the collar grip the deck plate by sandwiching it from above and below. The segments of the collar are uniform, and the deck anchor retains its perpendicularity, and does not move even under the pressure of concrete being poured thereon.

I claim:

1. In a deck anchor, for use in concrete building structures of the kind comprising:

i. a bolt including a head and a stem, said stem having a smooth portion adjacent said head and a screw-threaded portion remote from said head ii. an assembly including a washer slidable on the smooth portion of the stem, and a coaxial collar slidable on the threaded portion of the stem, said washer and collar being formed of resiliently deformable material, and said collar being axially slotted, and iii. a nut threadedly engaged on the threaded portion of said stem, the improvements which comprises, in combination:

a. said stem having said threaded portion of less diameter than said smooth portion thereof, thereby to present a radial shoulder where said portions meet b. said collar including an internal radial shoulder adapted to abut against said radial shoulder of the stem, thereby to permit the transmission of axial driving force from the bolt to the collar in the direction from the bolt head towards the nut c. said collar including a frusto-conical portion having a plurality of angular spaced axial slots, and a cylindrical portion connected integrally to the narrower end of said frusto-conical portion, and d. said frusto-conical portion being connected at its broader end to said washer by a plurality of fracturable bridging pieces disposed at angularly spaced positions about said frusto-conical portion intermediate neighbouring axial slots.

2. A deck anchor, as claimed in claim 1, wherein said assembly further comprises a metal plate seated on said washer and between said washer and said spring, said metal plate having lugs means thereon extending axially through and beyond the opening of said washer.

3. In combination:

a. a deck anchor as claimed in claim 1, and b. a deck plate including a hole, said hole allowing passage of said nut, said hole being of less maximum width than the maximum width of said washer and a part of said collar connected to said washer by said bridging means.

4. In combination:

a. a deck anchor, as claimed in claim 1, and b. a deck plate including a hole, said hole being of greater maximum width than said nut and allowing passage of said nut with clearance, said hole being of less diameter than the external diameter of said washer and being of a diameter intermediate the smaller and larger external diameters of said frusto-conical portion of said collar.

5. In combination:

A. the deck anchor and deck plate, as claimed in claim 3, and

B. a sheet of material secured to said nut.

6. In combination:

A. the deck anchor and deck plate, as claimed in claim 4, and

B. a sheet of material secured to said nut.

* * * * *